United States Patent [19]

Miller

[11] Patent Number: 4,939,851

[45] Date of Patent: Jul. 10, 1990

[54] BOAT SHOE

[75] Inventor: Harry Miller, Boston, Mass.

[73] Assignee: Omega Corporation, Boston, Mass.

[21] Appl. No.: 292,765

[22] Filed: Jan. 3, 1989

[51] Int. Cl.[5] ..... A43B 5/00; A43B 5/08; A43B 7/06; A43B 13/00

[52] U.S. Cl. ..... 36/3 B; 36/3 R

[58] Field of Search ..... 36/3 R, 3 B, 8.1, 28, 36/29

[56] References Cited

U.S. PATENT DOCUMENTS

| | | | |
|---|---|---|---|
| 30,391 | 10/1860 | Dexter | 36/3 B |
| 363,377 | 5/1887 | Faye | 36/8.1 X |
| 393,563 | 11/1888 | Howard | 36/3 B |
| 1,433,309 | 10/1922 | Stimpson | 36/8.1 |
| 4,438,573 | 3/1984 | McBarron | 36/3 B |
| 4,445,284 | 5/1984 | Sakutori | 36/3 B |
| 4,813,160 | 3/1989 | Kuznetz | 36/3 B |

*Primary Examiner*—John M. Jillions
*Assistant Examiner*—Yolanda B. Harris
*Attorney, Agent, or Firm*—Hale and Dorr

[57] ABSTRACT

Disclosed is a boat shoe that includes a sole constructed to allow for the flow of water from the interior of the shoe to the exterior of the shoe. The sole includes an innersole which is a removable orthotic with a series of openings through which water can pass. A rubber lasting board, which also has a series of openings to allow to pass through, is positioned between the innersole and a polyurethane midsole. The midsole includes a series of passageways molded into the upper surface of the midsole that direct the water towards the exterior of the shoe. In particular, these passageways lead to the exterior side portions of the shoe so that the water running through these passageways will flow from the interior of the shoe and out through the exterior side portions of the shoe.

4 Claims, 2 Drawing Sheets

BOAT SHOE

BACKGROUND OF THE INVENTION

The present invention relates to footwear and more particularly to a boat shoe which may be comfortably worn in an environment where the shoe will come into contact with water.

People wearing boat shoes frequently step into water while wearing the boat shoes thereby causing the shoes to fill with water. Most boat shoes are made of a durable non-porous material and as a result the water cannot escape from the shoe without removing the shoe to empty out the water, and having to remove a shoe is generally a nuisance. In addition, it is frequently not possible for the wearer of the shoes to remove a shoe as both hands may be occupied.

It is therefore the principal object of the present invention to provide a boat shoe that is made of a durable material and yet will allow for the release of water or other liquid from inside the shoe without removing the shoe.

It is a further object of the present invention to provide a boat shoe that allows the escape of water or another liquid from inside the shoe without adversely affecting the appearance of the boat shoe.

SUMMARY OF THE INVENTION

The boat shoe according to the present invention includes a sole constructed to allow for the flow of water from the interior of the shoe to the exterior of the shoe. The sole includes an innersole which is a removable orthotic with a series of openings through which water can pass. A rubber lasting board, which also has a series of openings to allow to pass through, is positioned between the innersole and a polyurethane midsole. The midsole includes a series of passageways molded into the upper surface of the midsole that direct the water towards the exterior of the shoe. In particular, these passageways lead to the exterior side portions of the shoe so that the water running through these passageways will flow from the interior of the shoe and out through the exterior side portions of the shoe.

These and other objects and features of the present invention will be more fully understood from the following detailed description which should be read in light of the accompanying drawings in which corresponding reference numerals refer to corresponding parts throughout the several views.

DETAILED DESCRIPTION OF THE PREFERRED EMBODIMENT

Figure 1:
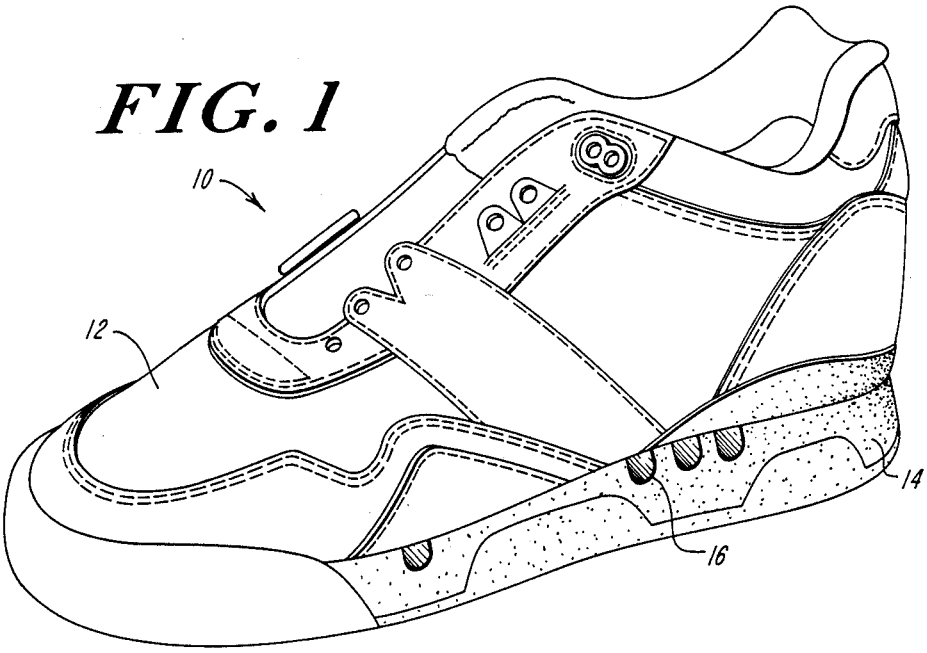
FIG. 1 is a perspective view of the boat shoe according to the present invention.

Referring to FIG. 1, the boat shoe 10 of the present invention includes an upper portion 12 which may be of any known design and is preferably constructed out of a durable material such as leather, although any known material used for footwear may be employed. The sole portion 14 is connected to the lower edges of the side regions of upper portion 12. The sole portion 14 includes openings 16 through which water escapes from inside the shoe.

Figure 2:
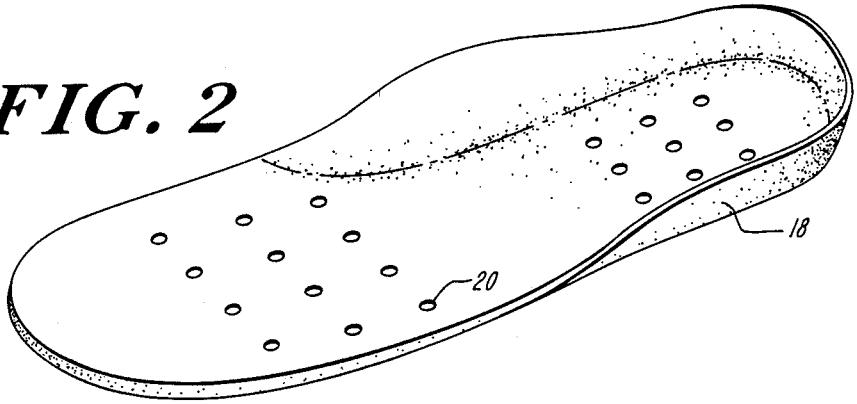
FIG. 2 is a perspective view of the innersole of the boat shoe shown in FIG. 1.
Figure 3:
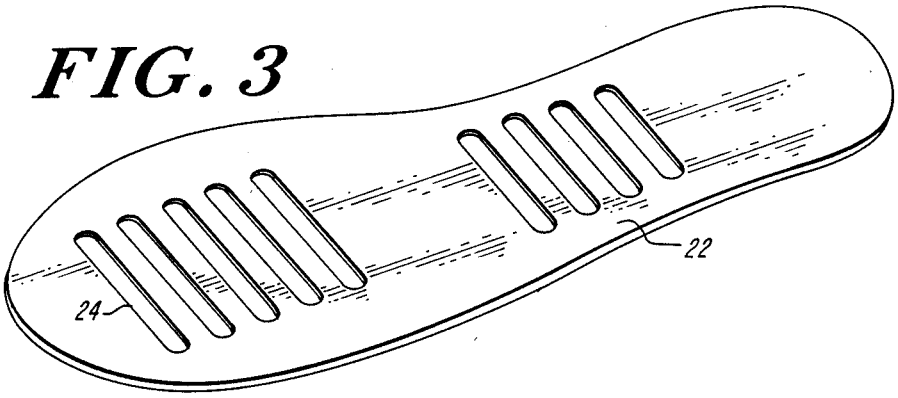
FIG. 3 is a perspective view of the lasting board of the boat shoe shown in FIG. 1.

Referring now to FIGS. 2–5, the sole portion 14 of the elements of the shoe will now be described. The innersole 18, which in a preferred embodiment is a removable orthotic, includes a series of openings 20 which as shown in a preferred embodiment of FIG. 2 are small circular openings arranged in row extending across the width of the innersole. A lasting board 22, which in a preferred embodiment is a rubber lasting board, is positioned beneath the innersole and includes a series of horizontal slot-like openings 24 that extend across the width of the lasting board 22. These openings are designed to be of a larger opening size than the holes 20, so that water embedded between the inner sole and the lasting board will easily pass through the slots 24.

Figure 4:
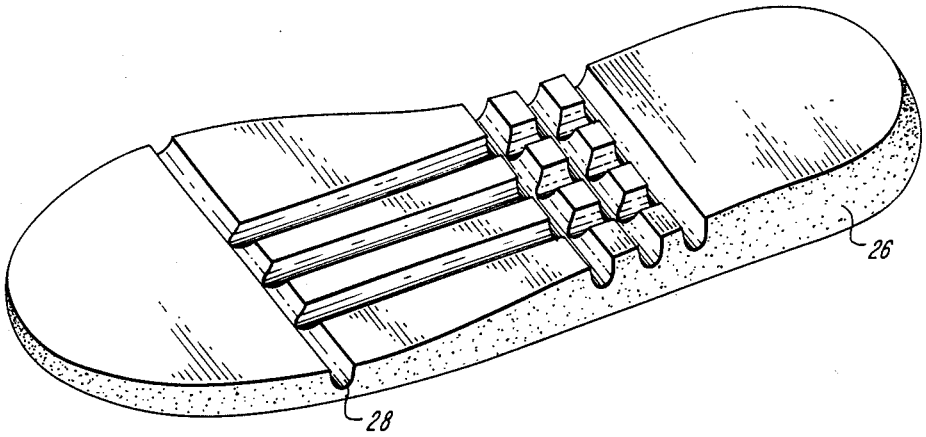
FIG. 4 is perspective view of a midsole of the boat shoe shown in FIG. 1.

Beneath the lasting board 22 is the midsole 26 which is shown most clearly in FIG. 4. It is this midsole 26 that includes the openings 16 through the side wall of the sole. Water passes through the slots 24 in the lasting board 22 into passageways 28 molded in the top of the midsole. In a preferred embodiment, the midsole is made of polyurethane which will not absorb water, but instead will keep the water in the passageways 28 so that it will eventually flow out of the side openings 16 which are located at the terminal ends of passageways 28.

Figure 5:
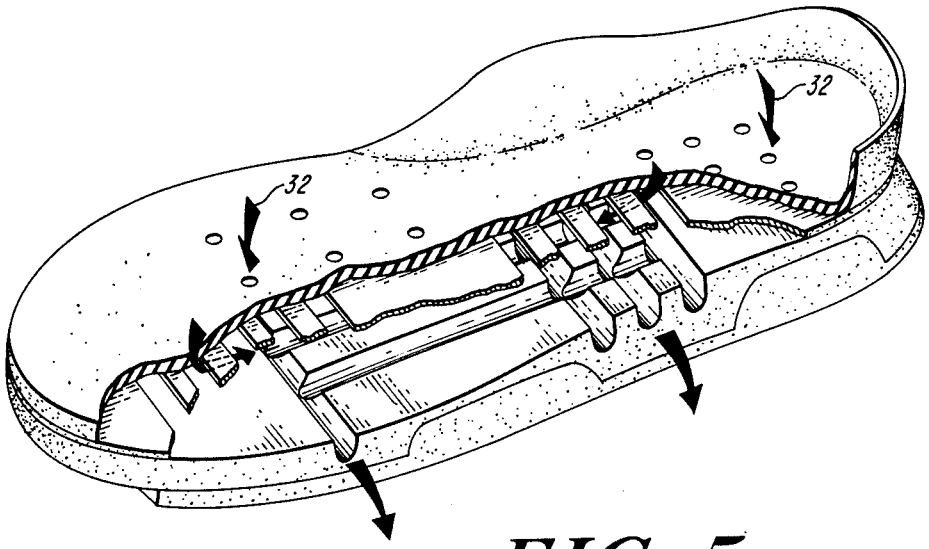
FIG. 5 is a perspective view partly in section of the sole construction of the boat shoe shown in FIG. 1.

When the shoe is in use and water gets inside the shoe, the water flows out of the shoe in a manner similar to that shown by arrows 32 in FIG. 5. As the wearer of the shoe gradually takes steps, more and more, and finally all, of the water passes through the holes 20, and starts its journey through the sole portion of the shoe and eventually out of the holes in the side wall 16. As a result, the shoe will never stay filled with water.

While the foregoing invention has been described with reference to its preferred embodiment, various alterations and modifications will occur to those skilled in the art. In addition, while the invention has been described with reference to a boat shoe, the invention is equally applicable to a shoe worn in any other embodiment in which the wearer's feet will come in contact with a liquid substance. All such variations and modifications are intended to fall within the scope of the appended claims.

What is claimed is:

1. A shoe that allows water or another liquid entering the interior o the shoe to freely flow out, said shoe comprising:

an upper portion including side and top surfaces;

a sole portion attached to lower edges of side surfaces of said upper portion, said sole portion including:

an innersole including a series of perforations therethrough;

an outersole positioned below said innersole, said outer sole including a series of passageways that communicate with said perforations in order to receive water or another liquid that passes through said perforations and to lead said liquid to the exterior of said outersole; and a lasting board positioned between said innersole and said outersole, said lasting board including openings that allow water or another liquid flowing through said perforations to enter said passageways.

2. The shoe of claim 1 wherein said passageways terminate at an outer surface of said outersole.

3. The shoe of claim 1 wherein said perforations have an area less than the area of said openings.

4. The shoe of claim 1 wherein said outersole is constructed of a non-absorbent material.

* * * * *